US009728120B2

(12) United States Patent
Matsumoto

(10) Patent No.: US 9,728,120 B2
(45) Date of Patent: Aug. 8, 2017

(54) DISPLAY APPARATUS

(71) Applicant: NICHIA CORPORATION, Anan-shi (JP)

(72) Inventor: Makoto Matsumoto, Itano-gun (JP)

(73) Assignee: NICHIA CORPORATION, Anan-shi (JP)

( * ) Notice: Subject to any disclaimer, the term of this patent is extended or adjusted under 35 U.S.C. 154(b) by 0 days.

(21) Appl. No.: 14/751,139

(22) Filed: Jun. 26, 2015

(65) Prior Publication Data

US 2015/0379968 A1 Dec. 31, 2015

(30) Foreign Application Priority Data

Jun. 27, 2014 (JP) ..... 2014-133010

(51) Int. Cl.
*G09G 3/32* (2016.01)

(52) U.S. Cl.
CPC ..... *G09G 3/32* (2013.01); *G09G 2310/08* (2013.01); *G09G 2330/025* (2013.01)

(58) Field of Classification Search
CPC ..... G09G 3/32; G09G 5/18; G09G 2310/08; G09G 2330/025
See application file for complete search history.

(56) References Cited

U.S. PATENT DOCUMENTS

2009/0243499 A1* 10/2009 Hsu ..... G09G 3/2014 315/169.3
2013/0120477 A1* 5/2013 Matsumoto ..... G09G 3/32 345/690
2013/0162696 A1* 6/2013 Matsumoto ..... G09G 3/32 345/690

FOREIGN PATENT DOCUMENTS

JP 2008-91311 A 4/2008

* cited by examiner

*Primary Examiner* — Nelson Rosario
(74) *Attorney, Agent, or Firm* — Mori & Ward, LLP

(57) ABSTRACT

A display apparatus includes a plurality of light emitting elements, at least one common line, a power supply, a plurality of drive lines, and a controller. The at least one common line is connected to first ends of the plurality of light emitting elements. The plurality of drive lines are connected to second ends of the plurality of light emitting elements. The controller is to execute delay control on lighting possible periods in which the plurality of light emitting elements are to light in unit delay control periods so that an order of delaying the lighting possible periods in a single unit delay control period among the unit delay control periods is different from an order of delaying the lighting possible periods in any one of the unit delay control periods other than the single unit delay control period.

16 Claims, 8 Drawing Sheets

DISPLAY APPARATUS

CROSS-REFERENCE TO RELATED APPLICATIONS

The present application claims priority under 35 U. S. C. §119 to Japanese Patent Application No. 2014-133010, filed Jun. 27, 2014. The contents of this application are incorporated herein by reference in their entirety.

BACKGROUND

Technical Field

The present disclosure relates to a display apparatus.

Description of Related Art

When a plurality of LEDs (light emitting elements) are driven simultaneously at an identical timing, the output voltage of the power supply temporarily drops due to an abrupt change in current, which unables lighting of the LEDs (light emitting elements) with a predetermined brightness until the output voltage is re-stabilized. Accordingly, there has been provided an LED drive apparatus (display apparatus) in which a plurality of LEDs (light emitting elements) are driven in order (i.e., driven with a delay time), as described in JP2008-91311A for example.

SUMMARY OF THE INVENTION

According to one aspect of the present invention, a display apparatus includes a plurality of light emitting elements, at least one common line, a power supply, a plurality of drive lines, and a controller. The at least one common line is connected to first ends of the plurality of light emitting elements. The power supply is to supply voltage to the plurality of light emitting elements. The plurality of drive lines are connected to second ends of the plurality of light emitting elements. The controller is to execute delay control on lighting possible periods in which the plurality of light emitting elements are to light in unit delay control periods so that an order of delaying the lighting possible periods in a single unit delay control period among the unit delay control periods is different from an order of delaying the lighting possible periods in any one of the unit delay control periods other than the single unit delay control period.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1A:
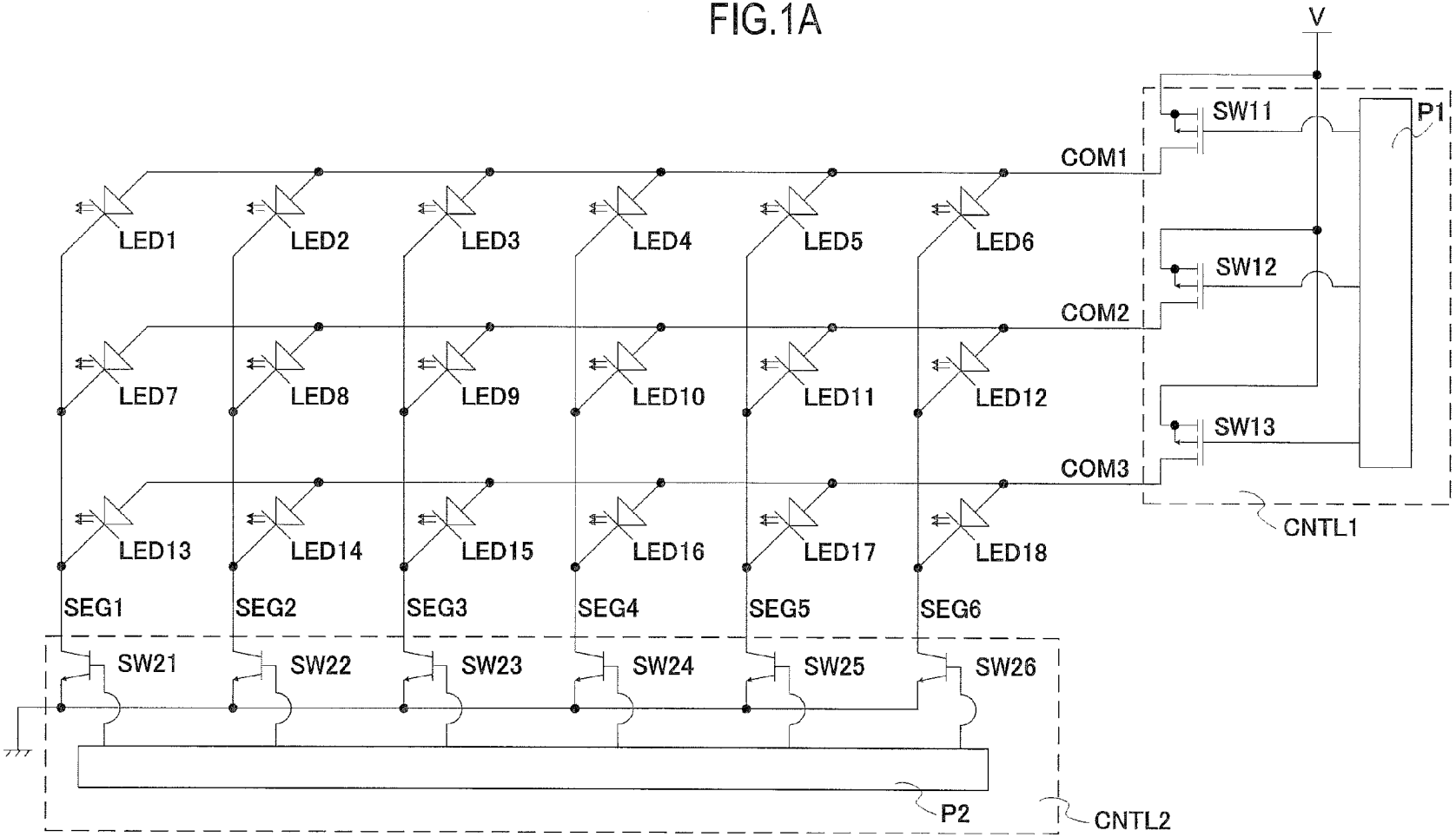
FIG. 1A is a circuit diagram of a display apparatus according to a first embodiment.

The embodiments will now be described with reference to the accompanying drawings, wherein like reference numerals designate corresponding or identical elements throughout the various drawings.

Display Apparatus According to First Embodiment

FIG. 1A is a circuit diagram of a display apparatus according to a first embodiment. As shown in FIG. 1A, the display apparatus 1 according to the first embodiment includes a plurality of LEDs 1 to 18, three common lines COM1 to COM3 connected to one ends of the plurality of LEDs 1 to 18, a power supply V to supply voltage to the plurality of LEDs 1 to 18, a plurality of drive lines SEG1 to SEG6 connected to other ends of the plurality of LEDs 1 to 18, and a control unit CNTL2 executing delay control on lighting possible periods of the plurality of LEDs 1 to 18 in unit delay control sections D (unit delay control sections are also referred to as "unit delay control periods"). The order of delaying of the lighting possible periods in a single unit delay control section D is different from the order of delaying in any one of other unit delay control sections D.

Figure 1B:
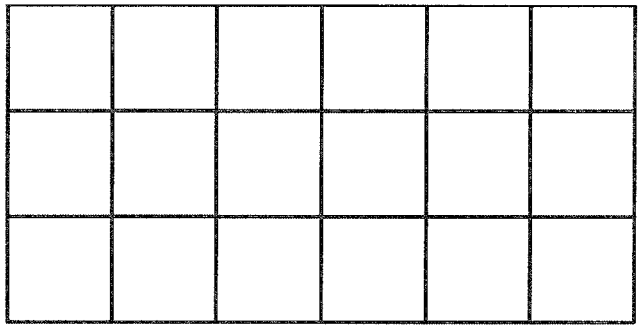
FIG. 1B is a diagram showing an exemplary display surface of the display apparatus according to the first embodiment.

FIG. 1B is a diagram showing an exemplary display surface of the display apparatus according to the first embodiment. As shown in FIG. 1B, the display surface of the display apparatus 1 according to the first embodiment is structured into a matrix of three rows and six columns using 18 sections. The plurality of LEDs 1 to 18 are respectively assigned to the 18 sections. For example, during the lighting period of the LED 10, the section to which the LED 10 is assigned (e.g., the section at the second row and the fourth column) is turned on, and during the lighting period of the LED 14, the section to which the LED 14 is assigned (e.g., the section at the third row and the second column) is turned on.

Figure 1C:
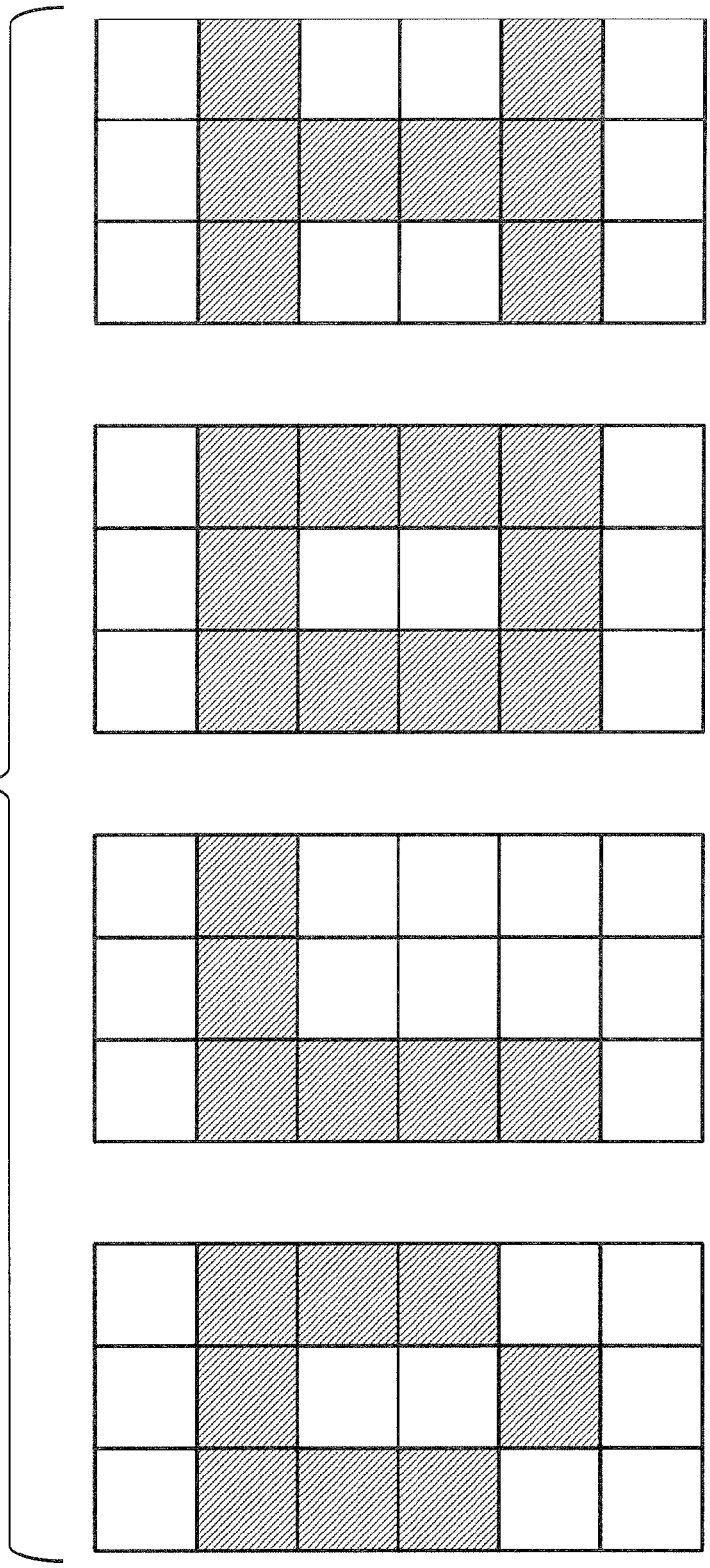
FIG. 1C is a diagram showing an exemplary series of displays.

FIG. 1C is a diagram showing an exemplary series of displays. As shown in FIG. 1C, the display apparatus 1 according to the first embodiment displays a series of displays "HOLD" on the display surface shown in FIG. 1B, upon operating the plurality of LEDs 1 to 18 to turn ON or turn OFF. Specifically, on the display surface shown in FIG. 1B, the letters "H", "O", "L", and "D" are shown in order of: "H"→"O"→"L"→"D". When the series of displays "HOLD" is shown with the conventional LED drive apparatus (display apparatus), for example a difference in brightness may occur between the lateral bar and the longitudinal bars in the letter "H", between the right side and the left side in the letter "O", between the lateral bar and the longitudinal bar in the letter "L", or between the right side and left side in the letter "D". On the other hand, with the display apparatus 1 according to the first embodiment, each of the letters "H", "O", "L", and "D" can be displayed with uniform brightness appearance. Note that "HOLD" is an example of a series of displays.

In the following, the description will be given in more detail.

(Plurality of LEDs 1 to 18)

As the plurality of light emitting elements, for example the plurality of LEDs 1 to 18 shown in FIG. 1A can be employed. The LEDs is an abbreviation for light emitting diodes.

(Common Lines COM1 to COM3)

The common lines COM1 to COM3 are connected to one ends of the plurality of LEDs 1 to 18. The plurality of LEDs 1 to 18 may be connected to the common lines COM1 to COM3 in a common anode configuration as shown in FIG. 1A, or in a common cathode configuration. For the common lines COM1 to COM3, a copper foil or the like can be used (e.g., part of the interconnection of the printed circuit board). In the printed circuit board or the like, the common lines COM1 to COM3 can be formed into various shapes such as a linear shape or planar shape (a rectangular shape, a circular shape, or the like). The expression "line" is not intended to limit the actual shape of the common lines COM1 to COM3 formed on the printed circuit board or the like to a linear shape. Instead, the expression is used just because the common lines COM1 to COM3 can be represented by lines when they are schematically shown in a circuit diagram. Each of the common lines COM1 to COM3 may be split (branched) in midway. Note that, although three common lines are employed in the present embodiment, at least one common line will be sufficient.

(Power Supply V)

The power supply V supplies voltage to the plurality of LEDs 1 to 18. In the case where two or more common lines are employed, the power supply V may be provided for each of the common lines COM1 to COM3, but the power supply V may be shared by two or more common lines COM1 to COM3 as shown in FIG. 1A. In the case where the power supply V is shared by the two or more common lines COM1 to COM3, the voltage of the power supply V may be continuously applied to the common lines COM1 to COM3 (the static control system), or may be applied time-divisionally (the dynamic control system, see FIGS. 2 to 5 to be described below). In the case where the voltage is time-divisionally applied to the two or more common lines, for example, as shown in FIGS. 2 to 5 to be described below, a control unit CNTL1 having an operation unit P1 and switches SW11 to SW13 is provided to each of the common lines, and the switches SW11 to SW13 are time-divisionally turned ON and OFF by the operation unit P1 of the control unit CNTL1. For the power supply V, for example, a DC constant voltage source of a series system or a switching system can be employed. For the operation unit P1 of the control unit CNTL1, a FPGA (Field Programmable Gate Array), a microcomputer, or a combination of those can be employed. Further, for the switches SW11 to SW13 of the control unit CNTL1, a P-channel FET (Field Effect Transistor), a PNP transistor or the like can be employed respectively. (Plurality of Drive Lines SEG1 to SEG6)

The plurality of drive lines SEG1 to SEG6 are connected to other ends of the plurality of LEDs 1 to 18. For the drive lines SEG1 to SEG6, a copper foil or the like (e.g., part of the interconnection of the printed circuit board) may be employed.

(Control Unit CNTL2)

The control unit CNTL2 executes a delay control on lighting possible periods of the plurality of LEDs 1 to 18 in a unit delay control section D. The control unit CNTL2 has an operation unit P2 and switches SW21 to SW26. The switches SW21 to SW26 are connected to the plurality of drive lines SEG1 to SEG6, respectively. The delay control is a timing control executed by the operation unit P2 of the control unit CNTL2. When the control unit CNTL2 turns on a certain LED, the control unit CNTL2 actually energizes the LED in a lighting possible period of the LED assigned by delay control (timing control), thereby turning on the LED. Note that, as will be described later, the control unit CNTL2 can execute delay control (timing control) not only by assigning lighting possible periods (the periods represented by solid lines and hatched areas in FIGS. 2 to 5) to lighting-target LEDs, but also by assigning lighting possible periods (the periods represented by broken lines FIGS. 2 to 5) to non lighting-target LEDs.

"Lighting Possible Period"

The lighting possible period refers to the period in which an LED can be caused to light. In the present embodiment, the period in which the control unit CNTL2 can turn ON the switches SW21 to SW26 corresponds to the lighting possible period. More specifically, the period in which the control unit CNTL2 can turn ON the switch SW21 corresponds to the lighting possible period of the LEDs 1, 7, and 13; the period in which the control unit CNTL2 can turn ON the switch SW22 corresponds to the lighting possible period of the LEDs 2, 8, and 14; the period in which the control unit CNTL2 can turn ON the switch SW23 corresponds to the lighting possible period of the LEDs 3, 9, and 15; the period in which the control unit CNTL2 can turn ON the switch SW24 corresponds to the lighting possible period of the LEDs 4, 10, and 16; the period in which the control unit CNTL2 can turn ON the switch SW25 corresponds to the lighting possible period of the LEDs 5, 11, and 17; and the period in which the control unit CNTL2 can turn ON the switch SW26 corresponds to the lighting possible period of the LEDs 6, 12, and 18. Note that, the foregoing is merely an example. Here, for example as shown in FIGS. 2 to 5, ON refers to the state where a signal is high, and OFF refers to the state where a signal is not high.

As described above, the control unit CNTL2 can execute delay control (timing control) by assigning lighting possible periods not only to lighting-target LEDs (see the periods represented by solid lines and hatched areas in FIGS. 2 to 5), but also to non lighting-target LEDs (see the periods represented by broken lines in FIGS. 2 to 5). In this case, the lighting-target LEDs are energized in their lighting possible periods (the periods represented by solid lines and hatched areas in FIGS. 2 to 5), while the non lighting-target LEDs are not energized in their lighting possible periods (the periods represented by broken lines in FIGS. 2 to 5). By assigning lighting possible periods not only to lighting-target LEDs, but also to non lighting-target LEDs, it becomes possible to execute delay control (timing control) without distinguishing the non lighting-target LEDs from the lighting-target LEDs, and the control can be simplified. Note that, the control unit CNTL2 can execute delay control (timing control) by assigning the lighting possible periods (the periods represented by solid lines and hatched areas in FIGS. 2 to 5) only to the lighting-target LEDs. In this case, the time required for equalizing brightness among the plurality of LEDs 1 to 18 can be shortened.

Each lighting possible period in an unit delay control period is set shorter than the length of the unit delay control section D. The length of a lighting possible period in a single unit delay control section D may be identical to that of a lighting possible period in each of other unit delay control sections D, or may be different from that of a lighting possible period in any one of other unit delay control sections D. Note that, by setting the length of a lighting possible period in a single unit delay control section D to be different from that of a lighting possible period in any one of other unit delay control sections D, the lighting possible periods can be modulated (i.e., subjected to grayscale weighting).

"Lighting Period"

The lighting period refers to the period in which an LED actually turns on in a lighting possible period. For example, the case where energizing is started from the beginning of a lighting possible period, the lighting period refers to the time period from the beginning of the lighting possible period to the end of the energizing within the lighting possible period. By the aforementioned modulation (grayscale weighting) of the lighting possible periods or PWM control (Pulse Width Modulation) of the lighting periods, a contrast of light and shade can be generated to lighting of the LEDs 1 to 18.

"Unit Delay Control Section D"

The unit delay control section D is the section serving as the unit of delay control, and a series of displays (e.g., "HOLD") is structured by a plurality of unit delay control sections D. The information presented by such a series of displays is not particularly limited. For example, such a series of displays may or may not convey a literal meaning. Further, the number of letters or symbols structuring a series of displays is not limited (though the present embodiment shows the mode in which such a series of displays is structured by the four letters "HOLD", it is merely an example as stated above). The number of the unit delay control sections D structuring a series of displays is not particularly limited. For example, two or more unit delay control sections D may be assigned to "H" in a series of displays "HOLD". Such a plurality of unit delay control sections D structuring a series of displays may be identical or different among each other in length. When the display apparatus 1 has completed the showing of a series of displays, the display apparatus 1 may repeatedly show the same series of displays, or may show other series of displays. Alternatively, the display apparatus 1 may end the operation.

The length of a delay time is not particularly limited. The delay time refers to the difference between the beginning time point of one lighting possible period and the beginning time point of the following lighting possible period. A transient response recovery time of the power supply V refers to the time that is taken until the output voltage of the power supply V recovers to a determined value when the load state of the power supply V has sharply changed.

Note that, it is particularly preferable that the delay time is equal to or shorter than the transient response recovery time of the power supply V. This is because when delay control is executed with the delay time equal to or shorter than the transient response recovery time, the delay time of the LEDs 1 to 18 becomes shorter, whereby the lighting possible period of the LEDs 1 to 18 becomes longer as described in "Reason Why Shorter Delay Time Increases Lighting Possible Period of LEDs" below, thus enabling the LEDs 1 to 18 to emit light with high luminance.

(Reason Why Shorter Delay Time Increases Lighting Possible Period of LEDs)

Here is an example. When the unit delay control section is 400 ns and the lighting possible period is assigned to all the 18 pieces of LEDs with a delay time of 10 ns, the length of the 18th lighting possible period becomes 230 ns (230 ns=400 ns−10 ns×17) at the maximum. However, with a delay time of 20 ns, the length of the 18th lighting possible period becomes 60 ns (60 ns=400 ns−20 ns×17) at the maximum. As can be seen from this example, in the present embodiment, the shorter the delay time, the longer the lighting possible period of the LEDs can be. Note that, when no delay control is executed, the delay time becomes 0 ns. Applying this to the specific example above, the length of the 18th lighting possible period becomes 400 ns (400 ns=400 ns−0 ns×17) at the maximum.

The order of delaying of the lighting possible periods in a single unit delay control section D is different from the order of delaying in any one of other unit delay control sections D. Thus, a uniform voltage distribution among the plurality of LEDs 1 to 18 throughout a plurality of unit delay control sections D can be obtained. In particular, in the case where delay control is executed with the delay time equal to or shorter than the transient response recovery time, the LEDs 1 to 18 are supplied with the output voltage of various values equal to or smaller than a determined value. In this case, conventionally, variations in brightness among the LEDs 1 to 18 are prominent. On the other hand, when the order of delaying is varied as described above, variations in voltage among the LEDs 1 to 18 are reduced when the plurality of unit delay control sections D are recognized as a whole, and variations in brightness among the plurality of LEDs 1 to 18 become not noticeable (or the variations become indistinctive, while they may be noticeable). For example, in a display apparatus in which delay control is executed with a delay time of 10 ns over three light emitting elements A, B, and C, the first light emitting element A is turned on at 0 ns; the second light emitting element B is turned on at 10 ns; and the third light emitting element C is turned on at 20 ns. In this case, if the transient response recovery time is 20 ns, the output voltage of the power supply V will drop simultaneously at the beginning of voltage supply to the first light emitting element A and will not recover to the original value for the following 20 ns. Accordingly, the first light emitting element A and the second light emitting element B cannot be supplied with the output voltage of a determined value. However, varying the order of delaying as described above, the order of delaying of the first unit delay control section D1 is A→B→C, the order of delaying of the second unit delay control section D2 being B→C→A, and the order of delaying of the third unit delay control section D3 being C→A→B. Thus, when the three unit delay control sections D1 to D3 are recognized as a whole, the three light emitting elements A, B, and C are treated equally, and the three light emitting elements A, B, and C are supplied with similar output voltage.

As the operation unit P2 of the control unit CNTL2, an FPGA (Field Programmable Gate Array), a microcomputer, or the combination thereof can be employed. Further, as the switches SW21 to SW26 of the control unit CNTL2, NPN transistors, N-channel FETs (Field Effect Transistors) or the like can be employed.

As has been described above, with the display apparatus 1 according to the first embodiment, the voltage supplied to the plurality of LEDs 1 to 18 can be equalized throughout the plurality of unit delay control sections D. Accordingly, it becomes possible to turn on the plurality of LEDs 1 to 18 with uniform brightness appearance. In particular, in the case where delay control is executed with a delay time equal to or shorter than the transient response recovery time, conventionally variations in brightness among the LEDs 1 to 18 are substantially prominent. On the other hand, with the display apparatus 1 according to the first embodiment, variations in voltage among the LEDs 1 to 18 are reduced when the plurality of unit delay control sections D are recognized as a whole. Thus, variations in brightness among LEDs 1 to 18 become not noticeable (or the variations become indistinctive, while they may be noticeable).

[First Exemplary Operation]

Figure 2:
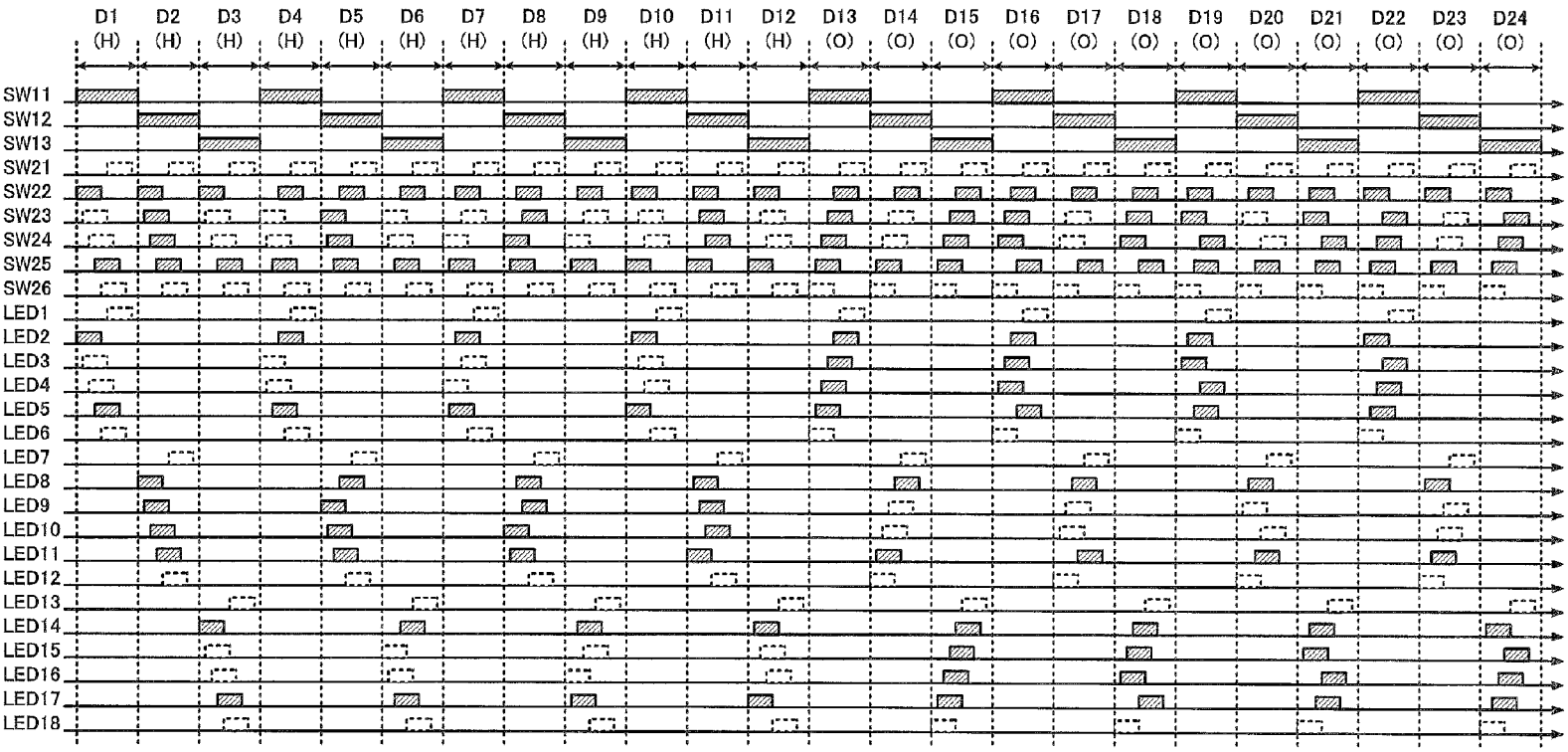
FIG. 2 is a timing chart for describing a first exemplary operation of the display apparatus according to the first embodiment.

FIG. 2 is a timing chart for describing a first exemplary operation of the display apparatus 1 according to the first embodiment. In the first exemplary operation, it is assumed that the four letters "H", "O", "L", and "D" are displayed in order of "H"→"O"→"L"→"D". Although FIG. 2 shows only "H"→"O" of "H"→"O"→"L"→"D" for avoiding redundancy (the unit delay control sections D1 to D12 correspond to the letter "H", while the unit delay control sections D13 to D24 correspond to the letter "O"), delay control can be executed on the letters "L" and "D" in a similar manner to the letters "H" and "O".

The order of delaying of the lighting possible periods is varied in the unit delay control sections D1 to D12 and in the unit delay control sections D13 to D24, except for the lighting possible periods (SW21, SW26) of the non lighting-target LEDs 1, 6, 7, 12, 13, and 18. That is, delay control is executed in the unit delay control sections D1 to D3 in order of the lighting possible period (SW22)→the lighting possible period (SW23)→the lighting possible period (SW24)→the lighting possible period (SW25); delay control is executed in the unit delay control sections D4 to D6 in order of the lighting possible period (SW23)→the lighting possible period (SW24)→the lighting possible period (SW25)→the lighting possible period (SW22); delay control is executed in the unit delay control sections D7 to D9 in order of the lighting possible period (SW24) the lighting possible period (SW25)→the lighting possible period (SW22)→the lighting possible period (SW23); and delay control is executed in the unit delay control sections D10 to D12 in order of the lighting possible period (SW25)→the lighting possible period (SW22)→the lighting possible period (SW23)→the lighting possible period (SW24). Further, delay control is executed in the unit delay control sections D13 to D15 in order of the lighting possible period (SW25)→the lighting possible period (SW24)→the lighting possible period (SW23)→the lighting possible period (SW22); delay control is executed in the unit delay control sections D16 to D18 in order of the lighting possible period (SW24)→the lighting possible period (SW23)→the lighting possible period (SW22)→the lighting possible period (SW25); delay control is executed in the unit delay control sections D19 to D21 in order of the lighting possible period (SW23)→the lighting possible period (SW22)→the lighting possible period (SW25)→the lighting possible period (SW24); and delay control is executed in the unit delay control sections D22 to D24 in order of the lighting possible period (SW22)→the lighting possible period (SW25)→the lighting possible period (SW24)→the lighting possible period (SW23). The order of delaying may be varied similarly between the unit delay control sections D1 to D12 displaying the letter "H" and in the unit delay control sections D13 to D24 displaying the letter "O". Alternatively, the order of delaying may be varied differently between them as shown in FIG. 2.

According to the first exemplary operation described above, it becomes possible to turn on the plurality of LEDs 1 to 18 with uniform brightness appearance.

[Second Exemplary Operation]

Figure 3A:
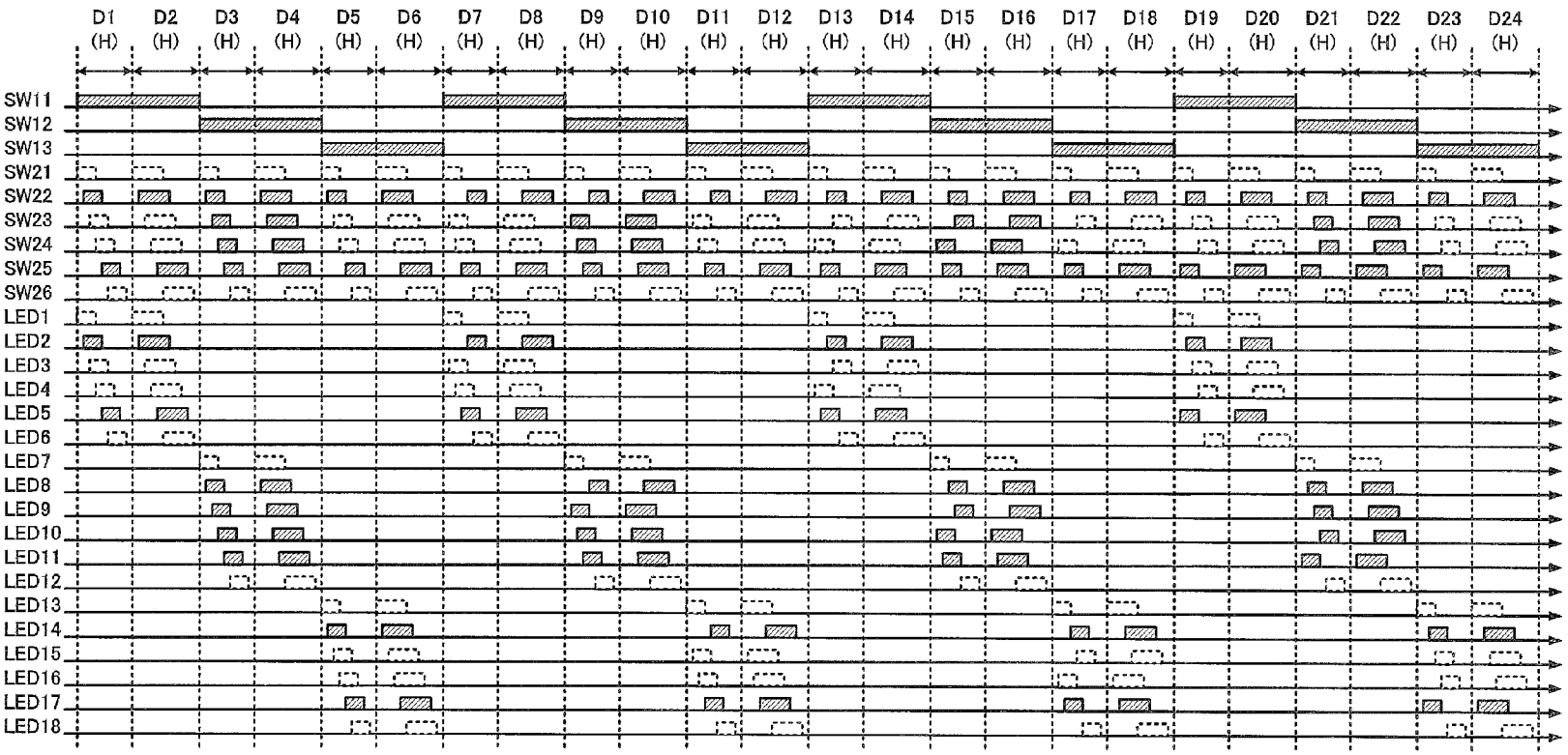
FIG. 3A is a timing chart for describing a second exemplary operation of the display apparatus according to the first embodiment.
Figure 3B:
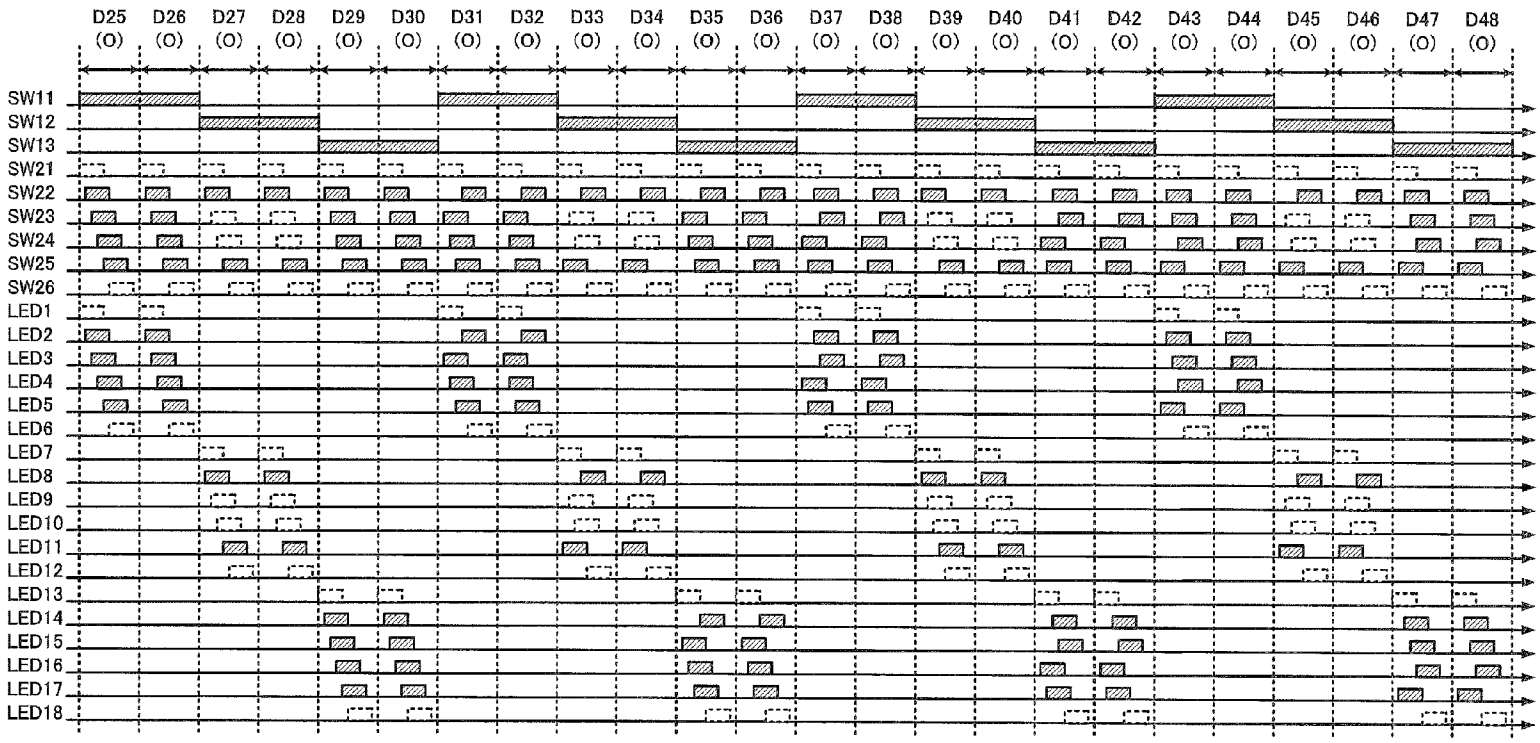
FIG. 3B is a continuation of FIG. 3A.

FIG. 3A is a timing chart for describing a second exemplary operation of the display apparatus 1 according to the first embodiment, and FIG. 3B is a continuation of FIG. 3A. In the second exemplary operation, it is assumed that the four letters "H", "O", "L", and "D" are displayed in order of "H"→"O"→"L"→"D". Though FIGS. 3A and 3B show only "H"→"O" of "H"→"O"→"L"→"D" for avoiding redundancy (the unit delay control sections D1 to D24 correspond to the letter "H", while the unit delay control sections D25 to D48 correspond to the letter "O"), delay control can be executed over the letters "L" and "D" similarly to the letters "H" and "O".

In the second exemplary operation, being different from the first exemplary operation, at least two unit delay control sections D become continuous for one common line. For example, in the first exemplary operation, SW11 turns ON in the unit delay control section D1 and voltage is applied to the common line COM1; SW12 turns ON in the unit delay control section D2 and voltage is applied to the common line COM2; SW13 turns ON in the unit delay control section D3 and voltage is applied to the common line COM3. On the other hand, in the second exemplary operation, SW11 turns ON in two unit delay control sections D1 and D2 and voltage is applied to the common line COM1; SW12 turns ON in two unit delay control sections D3 and D4 and voltage is applied to the common line COM2; and SW13 turns ON in two unit delay control sections D5 and D6 and voltage is applied to the common line COM3.

The length of the lighting possible periods or that of the unit delay control sections D may be or may not be identical to one another. Note that, while FIG. 3A shows an example in which the length of the lighting possible periods is varied (see the unit delay control sections D1 and D2) and the length of the unit delay control sections D is varied (see the unit delay control sections D1 and D2), the second exemplary operation is not limited thereto. As shown in FIG. 3B, in the second exemplary operation also, the length of the lighting possible periods or that of the unit delay control sections D may be identical to one another.

The order of delaying of the lighting possible periods is varied in the unit delay control sections D1 to 24 and in the unit delay control sections D25 to D48, except for the lighting possible periods (SW21, SW26) of the non lighting-targets LED 1, 6, 7, 12, 13, and 18. Specifically, delay control is executed in the unit delay control sections D1 to D6 in the order of delaying of the lighting possible period (SW22)→the lighting possible period (SW23)→the lighting possible period (SW24)→the lighting possible period (SW25); delay control is executed in the unit delay control sections D7 to D12 in the order of delaying of the lighting possible period (SW23)→the lighting possible period (SW24)→the lighting possible period (SW25)→the lighting possible period (SW22); delay control is executed in the unit delay control sections D13 to D18 in the order of delaying of the lighting possible period (SW24)→the lighting possible period (SW25)→the lighting possible period (SW22)→the lighting possible period (SW23); and delay control is executed in the unit delay control sections D19 to D24 in the order of delaying of the lighting possible period (SW25)→the lighting possible period (SW22)→the lighting possible period (SW23)→the lighting possible period (SW24).

According to the second exemplary operation described above also, similarly to the first exemplary operation, it becomes possible to turn on the plurality of LEDs 1 to 18 with uniform brightness appearance.

[Third Exemplary Operation]

Figure 4:
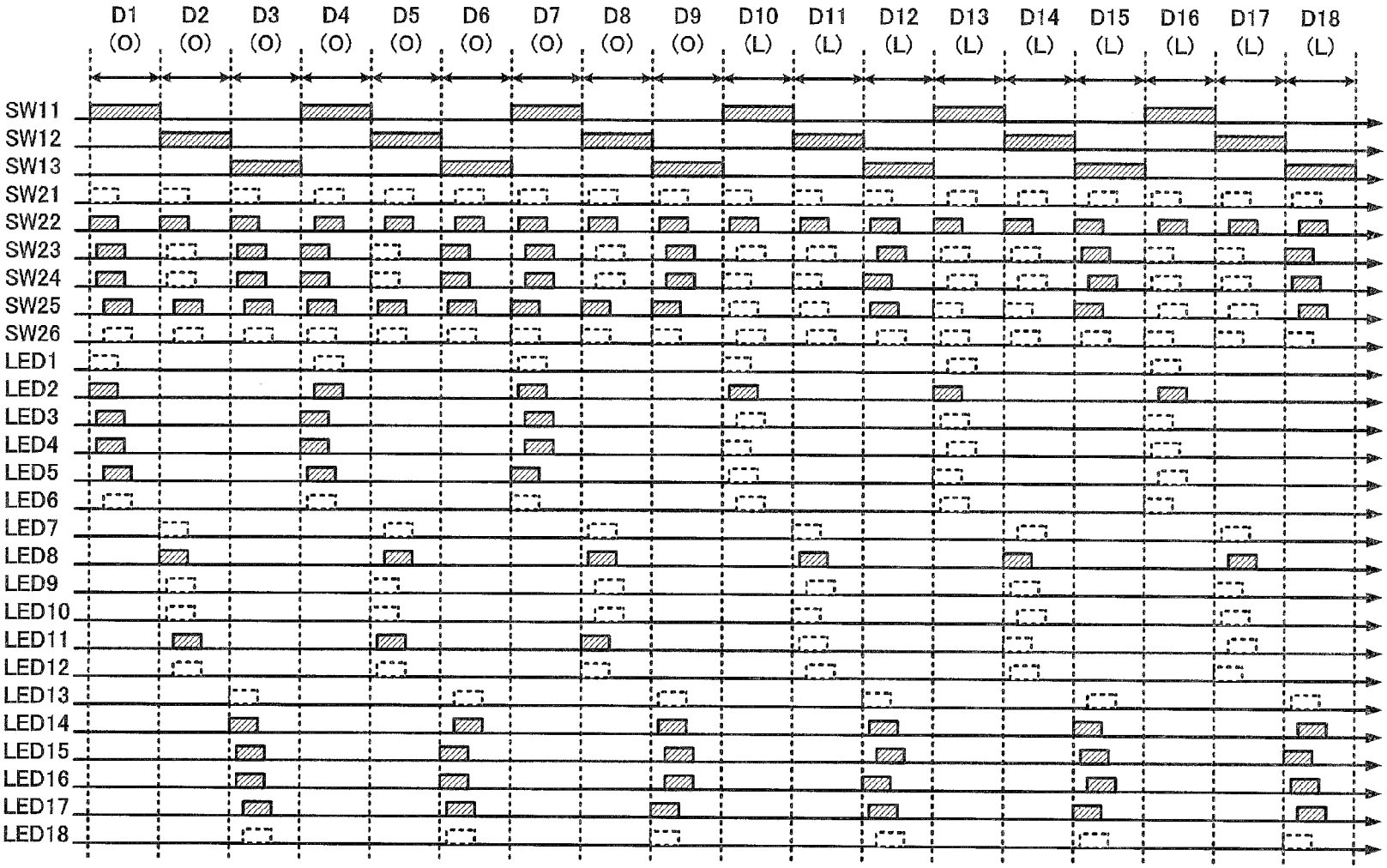
FIG. 4 is a timing chart for describing a third exemplary operation of the display apparatus according to the first embodiment.

FIG. 4 is a timing chart for describing a third exemplary operation of the display apparatus 1 according to the first embodiment. In the third exemplary operation, it is assumed that the four letters "H", "O", "L", and "D" are displayed in order of "H"→"O"→"L"→"D". Though FIG. 4 shows only "O"→"L" of "H"→"O"→"L"→"D" for avoiding redundancy (the unit delay control sections D1 to D9 correspond to the letter "O", while the unit delay control sections D10 to D18 correspond to the letter "L"), delay control can be executed over the letters "H" and "D" similarly to the letters "O" and "L".

In the third exemplary operation, being different from the first exemplary operation in which each light emitting element lights with different delay times, a group made of a combination of two or more light emitting elements is set, and the two or more light emitting elements belonging to the identical group are subjected to delay control with the same delay time. Specifically, in the unit delay control sections D1 to D9 in which the letter "O" is displayed, it is assumed that the LEDs 1, 7, and 13 (SW21) and the LEDs 2, 8, and 14 (SW22) belong to group A; the LEDs 3, 9, and 15 (SW23) and the LEDs 4, 10, and 16 (SW24) belong to group B; and that the LEDs 5, 11, and 17 (SW25) and the LEDs 6, 12, and 18 (SW26) belong to group C. Then, in the unit delay control sections D1 to D3, delay control is executed in order of group A (SW21, SW22)→group B (SW23, SW24)→group C (SW25, SW26); in the unit delay control sections D4 to D6, delay control is executed in order of group B (SW23, SW24)→group C (SW25, SW26)→group A (SW21, SW22); and delay control is executed in the unit delay control sections D7 to D9 in order of group C (SW25, SW26)→group A (SW21, SW22)→group B (SW23, SW24). Further, in the unit delay control sections D10 to D18 in which the letter "L" is displayed, it is assumed that the LEDs 1, 7, and 13 (SW21) and the LEDs 4, 10, and 16 (SW24) belong to group A; the LEDs 2, 8, and 14 (SW22) and the LEDs 5, 11, and 17 (SW25) belong to group B; and the LEDs 3, 9, and 15 (SW23) and the LEDs 6, 12, and 18 (SW26) belong to group C. Then, in the unit delay control sections D10 to D12, delay control is executed in order of group A (SW21, SW24)→group B (SW22, SW25)→group C (SW23, SW26); delay control is executed in the unit delay control sections D13 to D15 in order of group B (SW22, SW25)→group C (SW23, SW26)→group A (SW21, SW24); and delay control is executed in the unit delay control sections D16 to D18 in order of group C (SW23, SW26)→group A (SW21, SW24)→group B (SW22, SW25).

According to the third exemplary operation described above also, similarly to the first exemplary operation, it becomes possible to turn on the plurality of LEDs 1 to 18 with uniform brightness appearance.

[Fourth Exemplary Operation]

Figure 5:
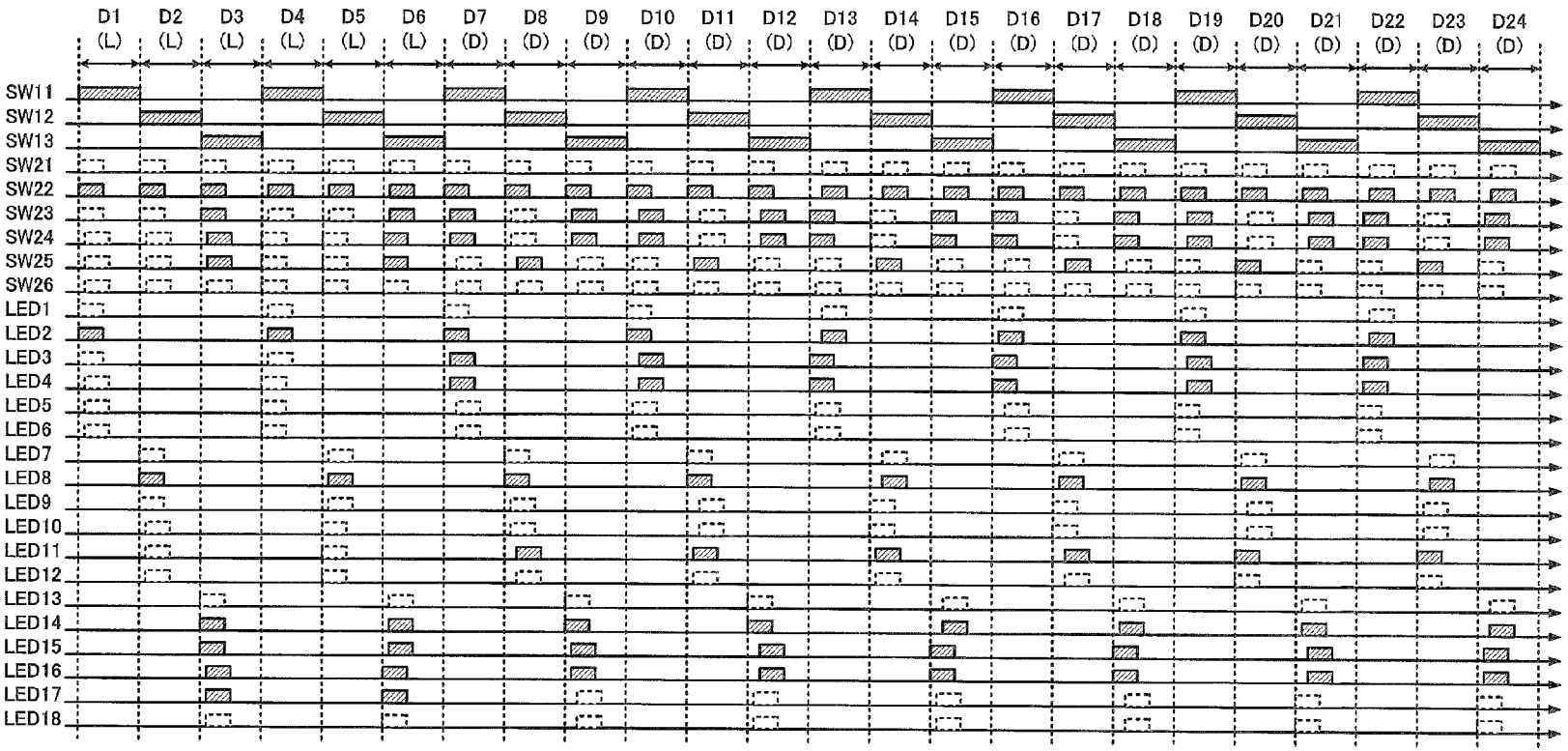
FIG. 5 is a timing chart for describing a fourth exemplary operation of the display apparatus according to the first embodiment.

FIG. 5 is a timing chart for describing a fourth exemplary operation of the display apparatus 1 according to the first embodiment. In the fourth exemplary operation, it is assumed that the four letters "H", "O", "L", and "D" are displayed in order of "H"→"O"→"L"→"D". Though FIG. 5 shows only "L"→"D" of "H"→"O"→"L"→"D" for avoiding redundancy (the unit delay control sections D1 to D6 correspond to the letter "L", while the unit delay control sections D7 to D24 correspond to the letter "D"), delay control can be executed over the letters "H" and "O" similarly to the letters "L" and "D".

In the fourth exemplary operation, being different from the third exemplary operation in which the number of the unit delay control sections D structuring a series of displays is smaller than the factorial of n (where n is the number of the LEDs 1 to 18 or the number of groups), the number of the unit delay control sections D structuring a series of displays is equal to the factorial of n (where n is the number of the LEDs 1 to 18 or the number of groups), and the order of delaying is different for each unit delay control section D.

Specifically, in the unit delay control sections D1 to D6 in which the letter "L" is displayed, it is assumed that the LEDs 1, 7, and 13 (SW21), the LEDs 2, 8, and 14 (SW22), and the LEDs 3, 9, and 15 (SW23) belong to group A; and that the LEDs 4, 10, and 16 (SW24), the LEDs 5, 11, and 17 (SW25), and the LEDs 6, 12, and 18 (SW26) belong to group B. Then, in the unit delay control sections D1 to D3, delay control is executed in order of group A (SW21, SW22, SW23)→group B (SW24, SW25, SW26); and in the unit delay control sections D4 to D6, delay control is executed in order of group B (SW24, SW25, SW26)→group A (SW21, SW22, SW23). Further, in the unit delay control section D7 to D24 in which the letter "D" is displayed, it is assumed that the LEDs 1, 7, and 13 (SW21) and the LEDs 2, 8, and 14 (SW22) belong to group A; that the LEDs 3, 9, and 15 (SW23) and the LEDs 4, 10, and 16 (SW24) belong to group B; and that the LEDs 5, 11, and 17 (SW25) and the LEDs 6, 12, and 18 (SW26) belong to group C. Then, in the unit delay control sections D7 to D9, delay control is executed in order of group A (SW21, SW22)→group B (SW23, SW24)→group C (SW25, SW26); in the unit delay control sections D10 to D12, delay control is executed in order of group A (SW21, SW22)→group C (SW25, SW26)→group B (SW23,SW24); in the unit delay control sections D13 to D15, delay control is executed in order of group B (SW23, SW24)→group C (SW25, SW26)→group A (SW21, SW22); in the unit delay control sections D16 to D18, delay control is executed in order of group B (SW23, SW24)→group A (SW21, SW22)→group C (SW25, SW26); delay control is executed in the unit delay control sections D19 to D21 in order of group C (SW25, SW26)→group A (SW21, SW22)→group B (SW23, SW24); and delay control is executed in the unit delay control sections D22 to D24 in order of group C (SW25, SW26)→group B (SW23, SW24)→group A (SW21, SW22).

According to the fourth exemplary operation described above also, similarly to the third exemplary operation, it becomes possible to turn on the plurality of LEDs 1 to 18 with uniform brightness appearance.

As in the first to third exemplary operations, in the case where the number of the unit delay control sections D structuring a series of displays is smaller than the factorial of n (where n is the number of the LEDs 1 to 18 or the number of groups), the time taken for equalizing the brightness of the plurality of LEDs 1 to 18 can be shortened. On the other hand, as in the fourth exemplary operation, in the case where the number of the unit delay control sections D structuring a series of displays is equal to the factorial of n (where n is the number of the LEDs 1 to 18 or the number of groups) and the order of delaying is different for each unit delay control section D, even when current flowing through the LEDs greatly varies among the LEDs 1 to 18, voltage supplied to the plurality of LEDs 1 to 18 becomes substantially constant when passing through the plurality of unit delay control sections D.

Example 1

Next, a description will be given of a display apparatus according to Example 1.

In connection with the display apparatus according to Example 1, 1,728 LEDs (including elements of three types, namely, Red, Green, and Blue) were disposed at a section of 4 mm longitudinally and laterally. Further, 24 common lines connected to anodes of the LEDs were disposed in the lateral direction, while 216 lines (72 lines×3 colors) of drive lines connected to cathodes of the LEDs were disposed in the longitudinal direction.

A DC 5V constant voltage source was employed as the power supply. A source driver having an FPGA and P-channel FETs operating on 5 V was employed as the control unit that time-divisionally applies voltage to the common lines. A sink driver having an FPGA and NPN transistors driven by a constant-current set to about 15 mA was employed as the control unit for drawing current from the drive lines.

The display apparatus according to Example 1 was dynamically driven at a duty ratio of 1/24. The period in which the source driver applies voltage to the common lines was employed as the unit delay control section. The length of each unit delay control section was set to 33.4 us. The length between each of the unit delay control sections was set to 10 us.

Further, in order to facilitate checking of whether the plurality of LEDs are turned on with uniform brightness appearance, all the 1728 LEDs arranged in a matrix were turned on to flash on and off in low light, and divided into five groups differing in the order of delaying. That is, the lighting periods in which the sink driver draws current were all set to 41.2 ns with the delay time of 16.7 ns.

The unit delay control sections of the common lines 1 to 24 were defined as one cycle. The LEDs on one common line were divided into five groups. The groups respectively contain 16-, 16-, 16-, 16-, and 8-pieces of LEDs from the left side on the display surface. The order of delaying in the first cycle unit delay control section was group 1→group 2→group 3→group 4→group 5; the order of delaying in the second cycle unit delay control section was group 2→group 3→group 4→group 5→group 1; the order of delaying in the third cycle unit delay control section was group 3→group 4→group 5→group 1→group 2; the order of delaying in the fourth cycle unit delay control section was group 4→group 5→group 1→group 2→group 3; and the order of delaying in the fifty cycle unit delay control section was group 5→group 1 group 2→group 3→group 4. From then on, the displays from the first to fifth cycles (an exemplary series of displays) were repeated.

When such a display apparatus was visually checked in a darkroom, the brightness among the plurality of LEDs was uniform, and the display on the entire surface was uniform. Accordingly, the display apparatus according to Example 1 can be evaluated as a high-quality display apparatus.

Comparative Example 1

Next, a display apparatus according to Comparative Example 1 is discussed.

As the display apparatus according to Comparative Example 1, a display apparatus basically structured similarly to the display apparatus according to Example 1 was employed. However, with the display apparatus according to Comparative Example 1, the order of delaying was fixed as group 1→group 2→group 3 group 4→group 5, and did not differ among the unit delay control sections. In connection with the display apparatus according to Comparative Example 1, the brightness among the plurality of LEDs was not uniform when the plurality of unit delay control sections were recognized as a whole. The brightness was varied as being gradually shaded from the left side on the display surface, namely among group 1 containing 24×16 areas, group 2 containing 24×16 areas, group 3 containing 24×16 areas, group 4 containing 24×16 areas, and group 5 containing 24×8 areas (brightened up from group 1 toward group 5).

In this manner, the brightness among the plurality of LEDs of the display apparatus according to Comparative Example 1 was not uniform, and uniform display on the entire surface was not provided. Accordingly, the display apparatus according to Comparative Example 1 can be evaluated as a low-quality display apparatus.

Comparative Example 2

Next, a display apparatus according to Comparative Example 2 is considered.

As the display apparatus according to Comparative Example 2, a display apparatus basically structured similarly to the display apparatus according to Example 1 was employed. However, with the display apparatus according to Comparative Example 2, the order of delaying was fixed as group 5→group 4→group 3→group 2→group 1, and did not differ among the unit delay control sections. In connection with the display apparatus according to Comparative Example 2, the brightness among the plurality of unit delay control sections was not uniform when the plurality of LEDs were recognized as a whole. The brightness was varied as being gradually shaded from the left side on the display surface, namely among group 1 containing 24×16 areas, group 2 containing 24×16 areas, group 3 containing 24×16 areas, group 4 containing 24×16 areas, and group 5 containing 24×8 areas (darkened from group 1 toward group 5).

In this manner, the brightness among the plurality of LEDs of the display apparatus according to Comparative Example 2 was not uniform, and uniform display on the entire surface was not provided. Accordingly, the display apparatus according to Comparative Example 2 can be evaluated as a low-quality display apparatus.

In the foregoing, while the description has been given of the embodiment and Examples, the description has been given by way of illustration and is not intended to limit the configuration stated in the scope of claims.

A display apparatus includes: a plurality of light emitting elements; at least one common line connected to one ends of the plurality of light emitting elements; a power supply supplying voltage to the plurality of light emitting elements; a plurality of drive lines connected to other ends of the plurality of light emitting elements; and a control unit executing delay control on lighting possible periods of the plurality of light emitting elements in unit delay control sections. The order of delaying of the lighting possible periods in a single unit delay control section is different from the order of delaying in any one of other unit delay control sections.

With the display apparatus described above, a plurality of light emitting elements can be turned on to achieve a uniform brightness appearance. In particular, in the case where delay control is executed with a delay time equal to or shorter than a transient response recovery time, variations in brightness among a plurality of light emitting elements may have been quite apparent. On the other hand, with the display apparatus described above, variations in brightness among a plurality of light emitting elements can be unnoticeable (or the variations become indistinctive, while they may be noticeable) upon observing the entire of a plurality of unit delay control sections.

Obviously, numerous modifications and variations of the present invention are possible in light of the above teachings. It is therefore to be understood that within the scope of the appended claims, the invention may be practiced otherwise than as specifically described herein.

What is claimed is:

1. A display apparatus comprising:

a plurality of light emitting elements;

at least one common line connected to first ends of the plurality of light emitting elements;

a power supply to supply voltage to the plurality of light emitting elements;

a plurality of drive lines connected to second ends of the plurality of light emitting elements; and a controller to execute delay control on lighting possible periods so that an order of delaying the lighting possible periods in a single unit delay control period among the unit delay control periods is different from an order of delaying the lighting possible periods in any one of the unit delay control periods other than the single unit delay control period, wherein the controller is configured to assign the lighting possible periods to lighting-target light emitting elements among the plurality of light emitting elements and to at least one non lighting-target light emitting element among the plurality of light emitting elements to execute the delay control, and the lighting-target light emitting elements turn on in lighting periods that are parts of or all of the lighting possible periods.

2. The display apparatus according to claim 1, wherein the at least one common line includes at least two common lines, and wherein the voltage from the power supply is time divisionally applied to each of the at least two common lines.

3. The display apparatus according to claim 1, wherein at least two of the unit delay control periods become continuous for one common line.

4. The display apparatus according to claim 1, wherein a total number of the unit delay control periods structuring a series of displays is smaller than a factorial of n, and wherein n represents a total number of the plurality of light emitting elements.

5. The display apparatus according to claim 1, wherein a total number of the unit delay control periods structuring a series of displays is equal to a factorial of n, wherein n represents a total number of the plurality of light emitting elements, and wherein an order of delaying the lighting possible periods is different for each of the unit delay control periods.

6. The display apparatus according to claim 1, wherein a group made of a combination of at least two of the plurality of light emitting elements is set, and wherein the at least two of the plurality of light emitting elements belonging to an identical group is subjected to the delay control with an identical delay time.

7. The display apparatus according to claim 6, wherein a total number of the unit delay control periods structuring a series of displays is smaller than a factorial of n, and wherein n represents a total number of the group.

8. The display apparatus according to claim 6, wherein a total number of the unit delay control periods structuring a series of displays is equal to a factorial of n, wherein n represents a total number of the group, and wherein an order of delaying the lighting possible periods is different for each of the unit delay control periods.

9. The display apparatus according to claim 1, wherein the controller assigns the lighting possible periods only to lighting-target LEDs to execute the delay control.

10. The display apparatus according to claim 1, wherein one of the lighting possible periods in one of the unit delay control periods is set shorter than a length of the one of the unit delay control periods.

11. The display apparatus according to claim 1, wherein a length of each of the lighting possible periods in a single unit delay control period is equal to a length of a lighting possible period in each of other unit delay control periods.

12. The display apparatus according to claim 1, wherein a length of each of the lighting possible periods in a single unit delay control period is different from a length of a lighting possible period in any one of other unit delay control periods.

13. The display apparatus according to claim 1, wherein two unit delay control periods become continuous for one common line, and wherein a length of each of the lighting possible periods in a former unit delay control period is shorter than a length of each of the lighting possible periods in a latter unit delay control period.

14. The display apparatus according to claim 1, wherein a delay time is equal to or shorter than a transient response recovery time of the power supply.

15. The display apparatus according to claim 1, wherein a series of displays are repeated with a plurality of cycles, and wherein an order of delaying the lighting possible periods in each of the unit delay control periods in a cycle is different from an order of delaying the lighting possible periods in each of the unit delay control periods in any one of other cycles.

16. The display apparatus according to claim 1, wherein an order of delaying the lighting possible periods in a single unit delay control period is different from an order of delaying the lighting possible periods in any one of other unit delay control periods so that a uniform voltage distribution among the plurality of light emitting elements throughout a plurality of unit delay control periods is obtained.

* * * * *